United States Patent [19]

Murasawa et al.

[11] Patent Number: 4,663,257

[45] Date of Patent: May 5, 1987

[54] METHOD OF COLOR ELECTROPHOTOGRAPHY

[75] Inventors: Sadao Murasawa, Itami; Hajime Murakami, Kusatsu; Nobuharu Oka, Shiga, all of Japan

[73] Assignees: Ishihara Sangyo Kaisha, Ltd., Osaka; Dainippon Screen Mfg. Co., Ltd., Kyoto, both of Japan

[21] Appl. No.: 779,026

[22] Filed: Sep. 23, 1985

[30] Foreign Application Priority Data

Sep. 26, 1984 [JP] Japan ..... 59-200966

[51] Int. Cl.[4] ..... G03G 13/10

[52] U.S. Cl. ..... 430/45; 430/119; 430/125; 355/4

[58] Field of Search ..... 430/45, 119, 125

[56] References Cited

U.S. PATENT DOCUMENTS 3,663,219 5/1972 Takahashi ..... 430/119
3,907,423 9/1975 Hayashi et al. ..... 355/10
3,933,490 1/1976 Tsuchiya ..... 430/125 X
4,105,322 8/1978 Inoue et al. ..... 355/4
4,286,039 8/1981 Landa et al. ..... 430/119

FOREIGN PATENT DOCUMENTS 2161194 6/1972 Fed. Rep. of Germany ..... 430/125

*Primary Examiner*—Roland E. Martin
*Attorney, Agent, or Firm*—Browdy and Neimark

[57] ABSTRACT

This invention is a method of color electrophotography in which toner images are superposed sequentially on a photosensitive material sheet to form a multi-color image by using a liquid developer. According to this method, the photosensitive material sheet is made to pass by a conductive doctor member and then by an air blasting member in sequence immediately after development, so as to form the multi-color image. By this method, the multi-color image can be formed in the condition that most of a excess developer is removed while a small quantity of carrier liquid containing no residual toner particles is made to exist as a uniform liquid layer on the surface of the photosensitive material sheet, and thus a clear image free from a fogging of the surface can be obtained.

14 Claims, 1 Drawing Figure

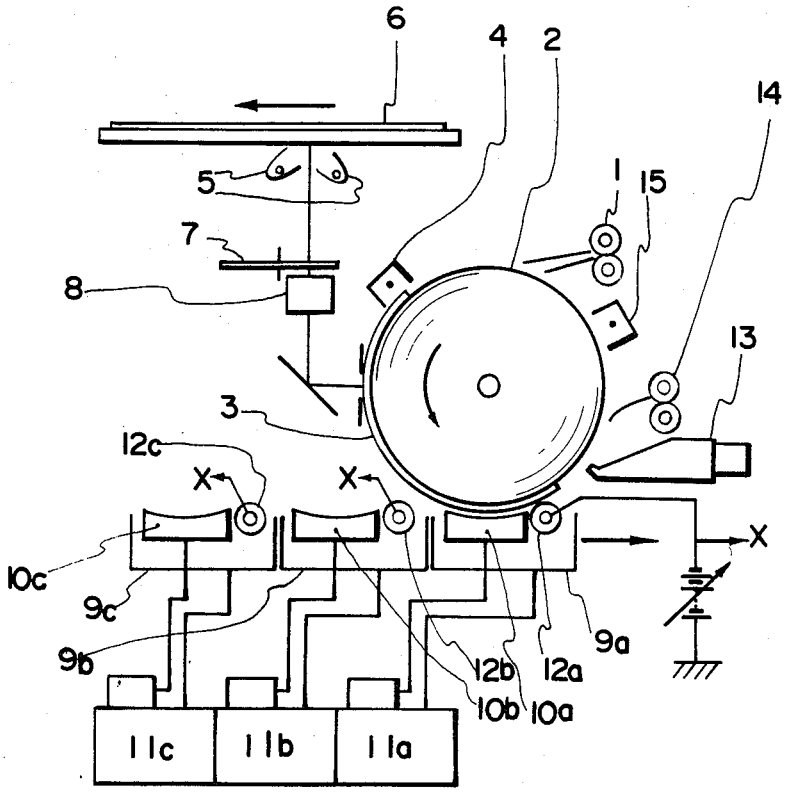
6
4
2
14
5
1
15
7
8
13
3
12c
X
X
X
10c
9c
9b
9a
12b
12a
10b
10a
11c
11b
11a

METHOD OF COLOR ELECTROPHOTOGRAPHY

FIELD OF THE INVENTION

The present invention relates to an electrophotographic system and particularly to an improved electrophotographic system for forming a series of images on the photosensitive material sheet to provide a composite multi colored image with substantially no fogging in the background or nonimage areas of the developed print by liquid development.

DESCRIPTION OF THE PRIOR ART

Color electrophotography by the Electro-Fax system (hereinafter called the EF system) is widely known, in which a photosensitive material sheet having a photoconductive layer provided on a electroconductive backing is charged with electricity and exposed to light. An electrostatic latent image thus formed is developed by using a liquid developer prepared by dispersing toner particles in an electrical insulating medium. This operation is repeated three to four times in accordance with a color-separated light from an original so as to complete an image.

When the electrostatic latent image formed on said photosensitive material sheet is developed by the liquid developer, this sheet is wetted thereby. Consequently, (i) the toner particles dispersed in the liquid developer stick on the surface of the photosensitive material sheet by a mechanical force and the attraction of the developer other than an electric force, causing a stain (so called Fogging) of the surface of the sheet.

Moreover, (ii) a so-called excess developer containing the toner particles remains on the surface of the photosensitive material sheet after development, and the surface stain is caused also by the toner particles remaining in said excess developer when this developer is removed.

In the application of the color electrophotography according to the aforesaid EF system, the surface stain caused in an image-forming process of each stage is an additive and impairs the quality of an image conspicuously. Therefore the settlement of this problem has been desired and sought.

Various proposals made so far for settling the problem have not yet led to any satisfactory result.

Among those methods proposed heretofore to settle the aforesaid problems, there is a well-known method, for instance, proposed for coping with the above-stated problem (i), in which the surface of the photosensitive material sheet is wetted beforehand with a carrier liquid to prevent the mechanical sticking of the toner particles on said surface and the attraction thereof by the liquid developer—a method in which a so-called pre-wetting step is taken before development.

Although this method is easily applied to a device for a monochromatic image, e.g. a black and white line image, said pre-wetting step must be embodied in a device for each color when the method is adapted to the color electrophotography in which an image is superposed on the photosensitive material sheet three or four times in succession and sequentially according to a color-separated light from an original to prepare a multicolor image, thereby complicating the device and increasing the cost thereof.

For the purpose of coping with the aforesaid problem (ii), on the other hand, there is a known method in which the excess developer remaining on the surface of the photosensitive drum just after the development in the PPC (Plain Paper Copier) system (an electrostatic latent image is formed on the photosensitive drum surface, then said latent image is converted to a toner image, subsequently, said toner image is transferred to a plain paper) is substantially removed by a device for squeezing out with pressing said excess developer on the toner image surface efficiently, i.e. a so-called squeeze roller, while a voltage of reverse polarity to a charge on the toner particles is impressed, on the occasion, on said squeeze roller so as to remove said toner particles remaining in the excess developer.

However, if the excess developer is squeezed out by means of said squeeze roller in preparing a multi-colored image by the EF system, the phenomenon described in (i) appears again in a subsequent developing process, and thereby the surface of the sheet is stained.

There is another known method in which the removal of the surplus developer is conducted by an air blasting means such as an air-knife. This method, however, requires a strong air flow, which causes such undesirable problems as the scattering of the developer, the formation of a streak on the formed image, noise, and the evaporation of a carrier liquid, etc.

SUMMARY OF THE INVENTION

The present invention is designed to settle the above-stated problems, and thus an object thereof is to furnish a method of color electrophotography according to the EF system, which enables the efficient prevention of the stain of the surface of the photosensitive material sheet by the use of a relatively simple means and the consequent stable formation of an image of high quality.

The present inventors conducted various studies and examinations for some time past for preventing the stain of the surface of the photosensitive material sheet in the color electrophotography according to the EF system, and found that the aforesaid problems could be solved by a method in which most of the excess developer remaining on the surface of the photosensitive material sheet just after development is removed by a doctor member and a subsequent air blasting member while at least a certain quantity thereof is maintained as a leveled liquid layer on the surface of said sheet, at which time a voltage reverse polarity to toner particles is impressed on the doctor member to prevent the toner particles remaining in the excess developer from sticking onto the photosensitive material sheet, thus producing a pre-wetting effect on the sheet. The present invention has been completed in this way.

BRIEF DESCRIPTION OF THE DRAWING

The drawing shows schematically one embodiment of a structure of a color electrographic device to which the present invention is applied.

DETAILED DESCRIPTION OF THE PREFERRED EMBODIMENT

The drawing shows schematically one example of a structure of a device of color electrophotography to which the present invention is applied, in which: numeral 1 denotes a feeding roller, 2 a conveyor drum, 3 a photosensitive material sheet, 4 an electrifier, 5 an exposure light source, 6 an original, 7 a color separation filter, 8 a lens, 9*a*, 9*b* and 9*c* developing devices, 10*a*, 10*b* and 10*c* opposite electrodes for development, 11*a*, 11*b* and 11*c* developer tanks respectively, 12 (12*a*, 12*b*, 12*c*)

electroconductive doctor rollers made of metal, as doctor members which are designed so that a voltage can be impressed thereon by a power source, 13 an air blasting nozzle, 14 a delivery roller, and 15 a static eliminator.

The photosensitive material sheet 3 is supplied onto the surface of the conveyor drum by the feeding roller 1 and held thereon.

At that time, said photosensitive material sheet 3 may be held by a clamp or the like, or it may also be retained on the drum with the back of the sheet wetted with an appropriate liquid.

It is further preferable that the surface of said sheet 3 is wetted beforehand with a carrier liquid so as to avoid toner particles sticking thereon due to the attraction of the liquid developer in the first-stage formation of an image.

With the rotation of the conveyor drum 2, the photosensitive material sheet 3 is first subjected to an initial corona discharge by the electrifier 4 to be charged uniformly with an electricity.

Next, the first-stage exposure is conducted with a color-separated light obtained by using a blue filter, for instance, as the color separation filter 7 in an exposure section comprising the exposure light source 5, the color separation filter 7 and the lens 8, and thereby an electrostatic latent image equivalent to the original 6 is formed on a photosensitive layer of the photosensitive material sheet 3. Then, development is made with a yellow toner developer corresponding to a blue-filter light in the developing device 9*a* in which a prescribed potential is impressed on the opposite electrode 10*a* for development, and thereby said image is turned into a visible image.

In the method of the present invention, the photosensitive material sheet 3 bearing the above visualized image is then transferred onto the electroconductive doctor roller 12*a* made of metal. By this roller, a voltage being higher than the residual potential in the non-image part of the sheet and reverse polarity to the toner particles is impressed on the developer sticking in a large quantity on the surface of the photosensitive layer, so as to remove the toner particles remaining in excess developer, and simultaneously the developer is shaped into a layer, while part of said excess developer is removed.

Thereafter the photosensitive material sheet 3 is conveyed to the air blasting nozzle 13, whereby the carrier liquid remaining on the surface of said sheet 3 is squeezed to a prescribed quantity without a toner layer in an image part being impaired.

By the above-stated processing, a substantially major part of the excess developer is removed from the surface of the photosensitive material sheet 3, while the carrier liquid containing no residual toner particles is maintained thereon so that it is 0.5 to 8 g per unit area ($m^2$) (about 0.5 to 10 $\mu$m in terms of liquid layer thickness) or preferably 1 to 5 g (about 1 to 6 $\mu$m in terms of said thickness).

When the quantity of the remaining carrier liquid is smaller than the aforesaid limit, the photosensitive material sheet 3 becomes dry, and this causes the sticking of toner particles on the surface of the sheet in a subsequent image-forming process, e.g. a magenta image formation, which causes the stain of the surface of the sheet and thus makes it impossible to reproduce a clear image.

When the quantity of the remaining the carrier liquid is larger than said limit, this produces an adverse effect on the characteristics of electrification and development in the subsequent image-forming process, resulting in an inevitable deterioration of the quality of an image.

In the method of the present invention, the aforesaid doctor rollers 12 (12*a*, 12*b*, 12*c*) are disposed so that they are opposite through a prescribed distance, 0.1 to 1.0 mm normally, to the peripheral surface of the conveyor drum 2, while the air blasting nozzle 13 is disposed along the direction of rotation of the drum 2 and in close proximity to said rollers 12 so that it is spaced at a prescribed distance (1 to 10 mm normally) from the peripheral surface of said drum.

The air blast from said nozzle 13 is conducted by using normal air, dry air or hot air sent under pressure, with proper adjustment of the angle of the nozzle 13 to the peripheral surface of the drum 2, the opening area thereof, and the quantity of air.

The liquid layer formed on the surface of the photosensitive layer can be squeezed thereby to a prescribed quantity without causing any streaking of the image. It is preferable that the angle of the nozzle 13 to the peripheral surface of the drum is substantially vertical thereto.

From the photosensitive material sheet 3 on which the first-stage image-forming operation is completed the electricity is removed by the static eliminator 15, and then a transfer is made to a second-stage image-forming process.

Since the carrier liquid layer, which is requisite and sufficient for producing a so-called prewetting effect, is maintained on the photosensitive material sheet 3, it is possible to proceed immediately to the following process of electrification without any special pre-wetting step.

When a multi-color image is formed of three primary colors of yellow, magenta and cyan, the image is visualized sequentially with each toner of magenta and cyan, for instance, in such a way as described above, and thereby a clear multi-color image being free from the surface stain and excellent in contrast can be formed without providing pre-wetting and washing steps for each image-forming process.

The photosensitive material sheet 3 having passed through a third-stage image-forming process necessitates no further pre-wetting effect for a subsequent stage. Therefore, the liquid on the photosensitive material sheet having passed through the above-described image-forming processes can be fully squeezed without any disadvantage. The sheet is discharged by the delivery roller 14 serving also as a liquid-squeezing element.

As said photosensitive material sheet 3 may be used for the present invention comprise a backing of relatively electrically conductive material sheet such as paper or plastic film coated with an electroconductive material, or of metal plate having a coating of electrophotoconductive material layer such as titanium dioxide, zinc oxide and the like dispersed in a resinous binder on one surface thereof to provide the electrophotoconductive surface, especially, in case that titanium dioxide containing photosensitive material sheet is employed in the present invention, thereby resulting multi-color print image having high contrast with good continuous gradation of the image such as that pictorial tone resembling the appearance obtainable in silver halide photography.

Using an electrophotographic apparatus constructed as shown in the drawing, a toner image of a first color (yellow) was formed according to the above-described method of the present invention, in which electrophotographic photosensitive paper (of thickness 15μ), which was prepared by laying on conductive base paper a photoconductive layer formed by dispersing titanium dioxide in electrically-insulative resin (acrylic resin), was held as the photosensitive material sheet on the aforesaid electroconductive conveyor drum, the surface of said photosensitive paper was electrified by negative corona (with an impressed voltage of 6 KV) with the rotation of said drum and then was subjected to color-separated exposure of the original through a blue filter so that an electrostatic latent image corresponding to the original might be formed thereon, and thereafter said latent image was developed to be the aforesaid toner image by a liquid developer of yellow. Subsequently, electrification, color-separated exposure through a green filter, development by a liquid developer of magenta, electrification, color-separated exposure through a red filter, and development by a liquid developer of cyan, were conducted sequentially in the same way as described above so as to superpose toner images of a second color (magenta) and a third color (cyan) sequentially on the toner image of the first color, and thereby a multi-color image was formed. In each process of forming the color image, in this case, the sheet was made to pass by the conductive doctor roller (the peripheral surface thereof was spaced by 0.5 mm from the surface of the opposite photosensitive material sheet, the residual potential in a non-image part was about −20 V and an impressed voltage was −30 V) and then by the air-blasting air-knife (the air knife was disposed so that the end of the nozzle thereof was spaced by about 3 mm from the surface of the photosensitive material sheet and virtually perpendicular thereto, and the speed of air flow was 15 m/sec.), thereby being processed so that the carrier liquid was maintained in a quantity of 2 g/m$^2$ on the surface of the sheet after the end of each image-forming process.

The multi-color image thus obtained showed a very low color density of 0.01 in non-image areas (measured by a reflection-type color density meter) due to little surface stain, thus being clear and excellent in contrast.

Another multi-color image was formed by a method similar to the above-described method of the present invention, except that a squeeze roller was made to contact under pressure the surface of the photosensitive material sheet 3 and air blasting was applied onto the surface of the sheet to put it in a dry state instead of the processing by the doctor rollers 12 and the air blasting nozzle 13. The image thus obtained showed a high color density of 0.30 in non-image areas due to much surface stain; it was not clear, and contrast was low.

Moreover, in the case when a pressure contact was made by a rubber roller to squeeze the excess developer, which was the practice of a conventional EF method, instead of the processing by the doctor rollers 12 and the air blasting nozzle 13 according to the aforesaid method of the present invention, the quantity of the carrier liquid remaining on the surface of the photosensitive material sheet was 0.3 g/m$^2$ or below, and the quality of a multi-color image thus obtained was considerably inferior to that obtained by the present invention.

In the method of the present invention, other embodiments can be designed, for instance, in which a conveyor body shaped in a flat plate is substituted for the above-mentioned conveyor body of a drum type, in which a non-conductive doctor member having a part opposed to the surface of the photosensitive material sheet kept conductive is employed in place of the above-mentioned doctor member made of metal, and in which any one of doctor members of various types, such as the one of a knife type, can be employed in place of the above-mentioned roller-type.

According to the present invention, as is seen from the foregoing description, the stain of the surface of the photosensitive material sheet can be prevented efficiently by a relatively simple means and thus a multi-color image of high quality can be obtained in a stable manner in the color electrophotographic method of the EF system.

In addition to a variety of characteristic features described above, the present invention has the following effect produced by the coordinated operations of said doctor and air-blasting members.

According to a method in which a excess developer is removed from the photosensitive material sheet by an air blasting member immediately after the sheet is conveyed out of a developing device, a larger quantity (by about 50%) of liquid developer is carried with the sheet than in the case when the sheet is made to pass by the doctor member. Therefore, if it is desired that the liquid be left on said sheet in the same quantity as left by the aforesaid coordinated operations, the quantity of air flow must be increased as much as required, which would cause the increases in the scattering of the developer, the streaks on an image, noise and the vaporization of a carrier liquid etc.

According to the present invention, these problems can be settled by the coordinated operations of the doctor and air-blasting members.

What is claimed is:

1. A method of color electrophotography comprising:

(a) forming an electrostatic latent image on a photosensitive material sheet having a photoconductive layer on an electroconductive backing and conveyed by an electroconductive conveyor means;

(b) developing said latent image with a liquid developer comprising toner particles dispersed in an electrically insulating carrier liquid;

(c) passing the developed photosensitive material sheet by an electroconductive doctor member having an electrical potential higher than a residual potential of a non-image part of the photosensitive material sheet and a charge of opposite sign to the charged toner particles, said electroconductive doctor member being in close proximity to the surface of said photosensitive material sheet;

(d) air blasting said photosensitive material sheet passed by said electroconductive doctor member to leave a layer of carrier liquid having a thickness of 0.5 to 0.8 g/m$^2$ upon said developed photosensitive conductive material sheet;

(e) repeating steps (a)–(d) on said air-blasted sheet having layer of said thickness of said carrier liquid thereon at least once to superimpose at least a second developed image on said initially developed image; and (f) fully squeezing the photosensitive material sheet obtained from step (e) to obtain a finished product having a composite developed image thereon.

2. A method of color electrophotography according to claim 1, wherein the removal of toner particles by the aforesaid electroconductive doctor member is conducted by a roller.

3. A method of color electrophotography according to claim 2, wherein said roller is made to operate with a prescribed very small gap from said electroconductive conveyor means.

4. A method of color electrophotography according to claim 1, wherein the air blasting is conducted by an air nozzle.

5. A method of color electrophotography according to claim 4, wherein said air nozzle is made to operate with a prescribed space to the peripheral surface of the electroconductive conveyor means.

6. A method of color electrophotography according to claim 4, wherein said air nozzle is made to operate in close proximity to said roller.

7. A method of color electrophotography according to claim 1, wherein said photosensitive material sheet has a photoconductive layer formed of titanium dioxide.

8. A method of color electrophotography according to claim 1, wherein steps (a)-(d) are performed at least three times, each time with a different color toner, to form a multi-color image.

9. A method of color electrophotography according to claim 1, wherein the conveyor means is a drum.

10. A method of color electrophotography according to claim 1, wherein said conveyor means is a flat-plate.

11. A method of color electrophotography according to claim 1, wherein the conductive doctor member is a roller.

12. A method of color electrophotography according to claim 1, wherein said conductive doctor member is spaced by 0.1 to 1 mm to the surface of the photosensitive material sheet opposite thereto.

13. A method of color electrophotography according to claim 1, wherein an air blasting member for performing step is perpendicular to the surface of the photosensitive material sheet.

14. A method of color electrophotography according to claim 13, wherein said conductive doctor member is spaced by 0.1 to 1 mm from the surface of the photosensitive material sheet opposite thereto.

* * * * *

UNITED STATES PATENT AND TRADEMARK OFFICE

CERTIFICATE OF CORRECTION

PATENT NO. : 4,663,257

DATED : May 5, 1987

INVENTOR(S) : Sada MURASAWA: Hajime MURAKAMI: Nobuharu OKA

It is certified that error appears in the above-identified patent and that said Letters Patent is hereby corrected as shown below:

Column 6, line 57 (Claim 1) change "0.8" to -- 8 --.

Signed and Sealed this

Twenty-sixth Day of April, 1988

*Attest:*

DONALD J. QUIGG

*Attesting Officer*

*Commissioner of Patents and Trademarks*